US005160136A

United States Patent [19]

Eger

[11] Patent Number: 5,160,136

[45] Date of Patent: Nov. 3, 1992

[54] GOLF CLUB CONSTRUCTION

[76] Inventor: Kevin D. Eger, 3030 Whetrock La., Sugarland, Tex. 77479

[21] Appl. No.: 619,053

[22] Filed: Nov. 28, 1990

[51] Int. Cl.[5] ..... A63B 53/00

[52] U.S. Cl. ..... 273/77 A; 273/169; 273/167 F

[58] Field of Search ..... 273/77 R, 77 A, 167 R, 273/167 D, 167 F, 167 H, 169, 172

[56] References Cited

U.S. PATENT DOCUMENTS

| | | | |
|---|---|---|---|
| 3,059,926 | 10/1962 | Johnstone | 273/77 A |
| 4,645,207 | 2/1987 | Teramoto et al. | 273/77 A |
| 4,715,601 | 12/1987 | Lamanna | 273/77 A |
| 4,848,747 | 7/1989 | Fujimara et al. | 273/77 A |
| 4,854,580 | 8/1989 | Kobayashi | 273/77 A |
| 4,923,197 | 5/1990 | Schacht | 273/77 A |

*Primary Examiner*—William H. Grieb
*Assistant Examiner*—William M. Pierce
*Attorney, Agent, or Firm*—Willian Brinks Olds Hofer Gilson Lione

[57] ABSTRACT

An improved construction for a golf club iron is disclosed. The disclosed pattern of cavity size and positioning in a ten club set of golf irons combines shortening cavity length with increasing distance between the cavity and the sole of the club as the length of the club decreases. At the same time, the distance from the cavity to the toe remains uniform, as does the distance to the upper edge of the blade. The result is that the center of gravity and weight of the club balde moves proportionately upwardly and toward the heel of the club as the club gets shorter.

3 Claims, 3 Drawing Sheets 510
515
516
520
521
526
527

610
615
616
620
621
626
627

710
715
716
720
721
726
727

810
815
816
820
821
826
827

910
915
916
920
921
926
927

GOLF CLUB CONSTRUCTION

FIELD OF THE INVENTION

This invention relates in general to golf clubs. It relates particularly to the construction, including configuration and weight distribution, of the iron clubs in a set of golf clubs.

BACKGROUND OF THE INVENTION

In recent years it has become popular, in the iron clubs of a set of golf clubs, to provide a central cavity in the back of each club head in order to concentrate the weight of the head around its perimeter. This concept is called "perimeter weighting". The shape and positioning of the cavity relative to the head determine the distribution of weight in the club head.

It is further known in such perimeter weighted clubs, where club head cavities are employed to produce perimeter weighting, that as club length decreases the cavity size should decrease. Thus, in the longest one iron, for example, a large cavity is used to produce the maximum perimeterization of weight. In contrast, in a shorter ten iron (pitching wedge), for example, a small cavity is used and perimeter weighting is less accentuated. In practice, the ten iron head is considerably heavier than the one iron head; as much as 25%, for example.

SUMMARY OF THE INVENTION

Against this background, an object of the present invention is to provide an improvement in golf club iron construction.

It is another object to provide an improvement in the weighting pattern in a set of iron clubs.

It is yet another object to provide an improvement in the pattern of perimeter weighting of golf club irons.

In is still another object to provide a new and improved progressive weight distribution pattern in golf club irons determined by moving the center of a cavity at a 45% degree angle up from the sole of the club and toward the toe of the club as a function of shortening club length, whereby the center of gravity and weight of the club blade moves proportionally upwardly and toward the heel of the club as the club gets shorter.

The foregoing and other objects are realized in accord with the present invention by providing a pattern of cavity size and positioning in a ten club set of golf irons which combines shortening cavity length with increasing distance between the cavity and the sole of the club as the length of the club decreases and loft increase, i.e., from the longer to the shorter irons, as they are called. At the same time, the distance from the cavity to the toe remains uniform, as does the distance to the upper edge of the blade. The result is that the center of gravity and weight of the club blade moves proportionally upwardly and toward the heel of the club as the club gets shorter.

The result of this dimension pattern is that the cavity is widest in the longest irons. This produces the greater playability of the cavity back design, i.e., it is more forgiving on imperfectly hit shots. The cavity narrows, moving through the shorter irons, producing more of a tour blade design for greater control in these clubs, i.e., it is less forgiving and provides greater "feel".

At the same time the longer irons carry more weight near the toe to promote staying down and through the shot, while the center of gravity and weight progressively move toward the heel, through the mid and shorter irons, to provide greater control and prevent pulling left on these shots. Furthermore, more weight is concentrated at the bottom of the long irons so that the ball gets up more quickly while, at the same time, in the shorter irons the weight progressively moves up to provide greater control and a lower shot trajectory.

The foregoing cavity size and location pattern, coupled with the cavity depth and club head size (the ten iron blade is widest and each longer iron progressively slimmer) produce varying club head weights, i.e., swing weights. They vary from a lowest swing weight in the one iron progressively to a highest swing weight in the ten iron or pitching wedge.

BRIEF DESCRIPTION OF THE DRAWINGS

The invention, including the construction and pattern of weighting club heads in a set of golf irons, is illustrated diagrammatically in the drawings, in which.

DESCRIPTION OF THE PREFERRED EMBODIMENT

Figure 1:
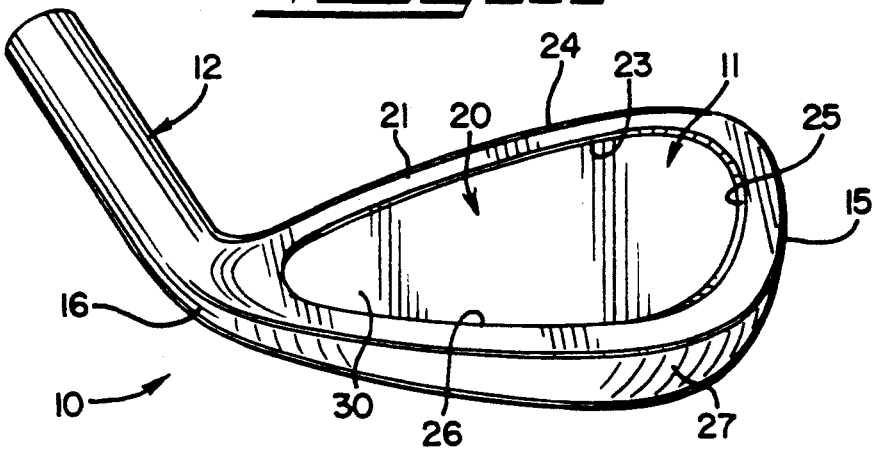
FIG. 1 is a rear elevational view of a one iron head, with a view taken normal to the face of the club head.
Figure 2:
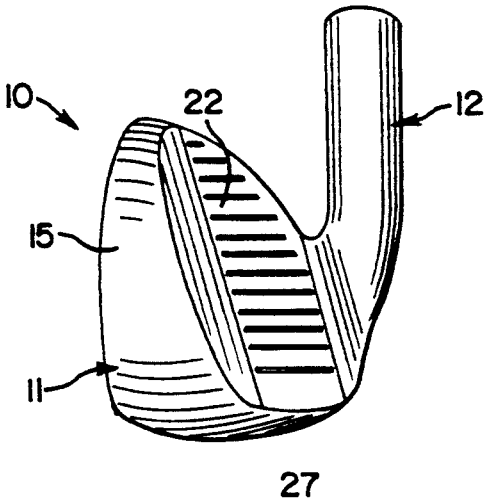
FIG. 2 is a toe end view of the club head shown in FIG. 1.
Figure 3:
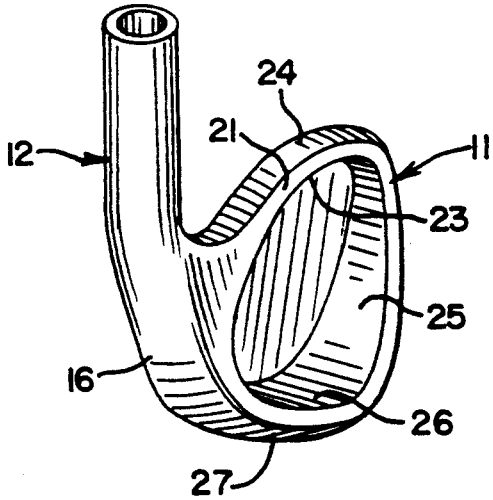
FIG. 3 is a heel and hosel end view of the club head shown in FIG. 1.
Figure 4:
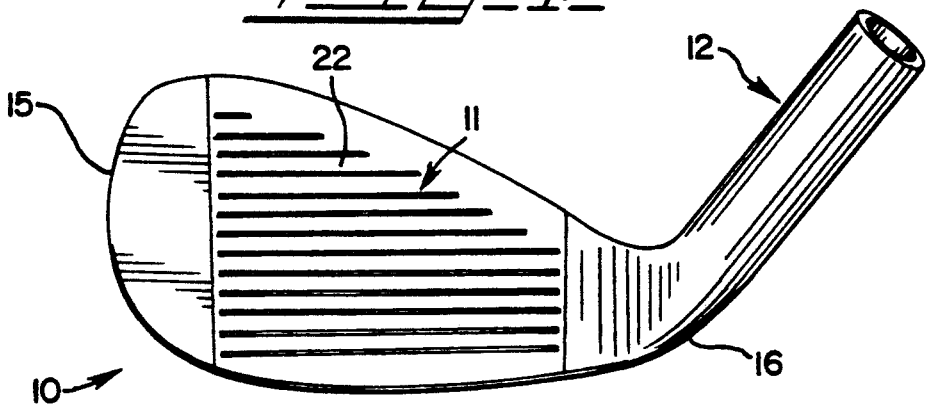
FIG. 4 is a face or front elevational view of the club head shown in FIG. 1.

Referring now to the drawings, and particularly to FIGS. 1–4, a one iron golf club head embodying features of the present invention is shown generally at 10. The club head 10 includes a blade 11 with which the ball is struck and a hosel 12 which connects the blade to the club shaft (not shown).

As will be seen in FIG. 1, the blade 11 is essentially egg-shaped, with the larger end at the toe 15 of the head and the smaller end at the heel 16 of the blade. This is a conventional configuration, providing a larger striking area for the ball on the face 17 of the club toward the toe 15, where the ball is normally struck. It also places the greater mass of the club out near the toe, so that the club has less tendency to rotate in the hands of the golfer as the ball is struck.

According to the invention, a cavity 20 is disposed in the back 21 of the blade 11, opposite the face 22 of the blade. Looking at the back 21 of the blade, the cavity 20 has substantially the same outline as the back, and is only slightly smaller than the back. As with each of the irons, one through ten, the distance from the upper edge 23 of the cavity 20 to the top 24 of the blade is uniformly about 9/32 of an inch, and the distance of the front edge 25 of the cavity from the toe 15 of the blade is uniformly about ¼ of an inch. The distance of the lower edge 26 of the cavity from the sole 27 of the blade varies from club to club, according to the invention, as does the length of the cavity. The distance from the back edge 29 of the cavity to the toe 15 varies as the length of the cavity between its front and back edges 25 and 29 varies, in a manner hereinafter discussed.

In the one iron the cavity is 2 and 27/32 inches long and is spaced 6/32 inches from the sole of the blade. The base or bottom 30 of the cavity is substantially planar and parallels the face 22 of the blade 11. Consequently, in the one iron, where the overall dimensions of the cavity 20 are the greatest and the lower edge 26 of the cavity 20 extends to within 6/32 of an inch of the sole 27 of the blade 11, the depth of the cavity along its lower edge 26 is quite large.

In the one iron then, the perimeter weighting of the club head 10 is most pronounced and the size of the cavity is as large as the desired head weight permits. The on iron club head 10 is the lightest of the ten iron clubs in the set.

Figure 5:
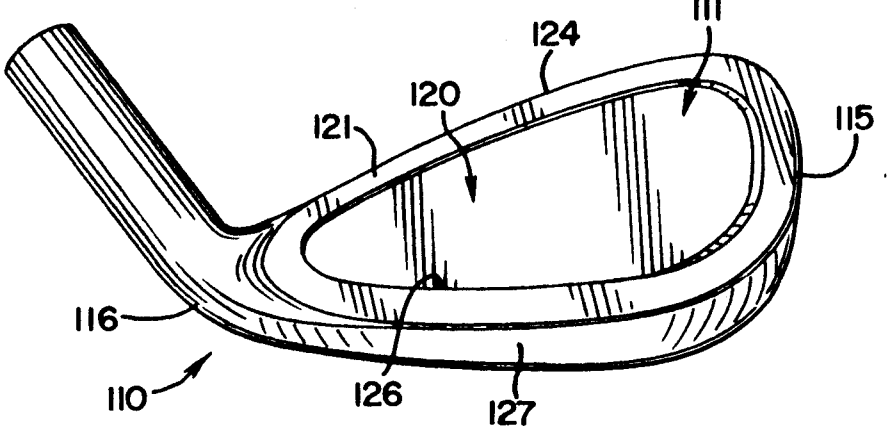
FIG. 5 is a back elevational view of a two iron head, with a view taken normal to the face of the club head.

Referring now to FIG. 5, the construction of the club head 110 for the two iron is illustrated. In the illustration of FIG. 5, the components of the head 110 are identified by the same reference numerals, plus one hundred digits, as the corresponding components of the one iron head 10.

The club head 110 differs from the head 10 of the one iron in that the cavity 120 in the back 121 of the blade 111 is narrower and shorter. As such, its center is moved upwardly and outwardly toward the toe 115 of the blade at a 45° angle. Here, the lower edge 126 of the cavity 120 is 9/32 of an inch from the sole 127 of the blade 111. The cavity 120 is now 2 and 26/32 inches long. The center of gravity and weight of the club head 110 has moved slightly upwardly and toward the heel 116.

Figure 6:
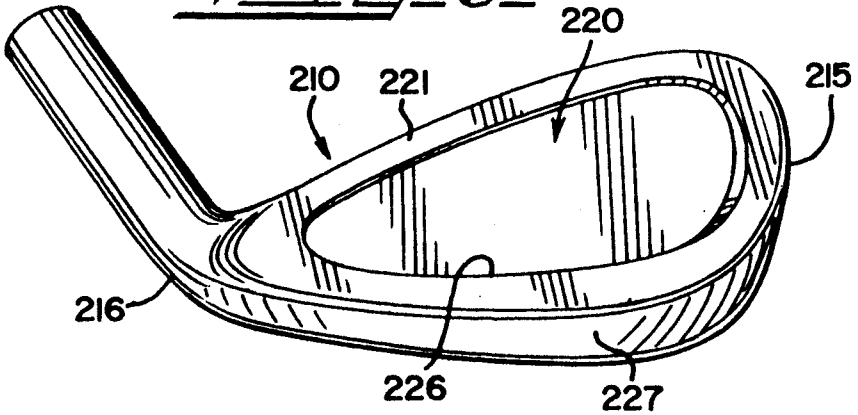
FIG. 6 is a back elevational view of a three iron head, with a view taken normal to the face of the club head.

Referring now to FIG. 6, the construction of the club head 210 for the three iron is illustrated. In the illustration of FIG. 6, the components of the head 210 are identified by the same reference numerals, plus 200 digits, as the corresponding components of the one iron head 10.

The club head 210 differs from the head 110 of the two iron in that the cavity 220 in the back 221 of the blade 221 is still narrower and shorter so that its center is effectively moved further upwardly and outwardly toward the toe 215 of the blade 211 at a 45° angle. Here, the lower edge 226 of the cavity 220 is 11/32 of an inch from the sole 227 of the head 210. The cavity is 2 and 23/32 inches long. The center of gravity and weight of the club head 210 has again moved slightly further upwardly and toward the heel 216.

Figure 7:
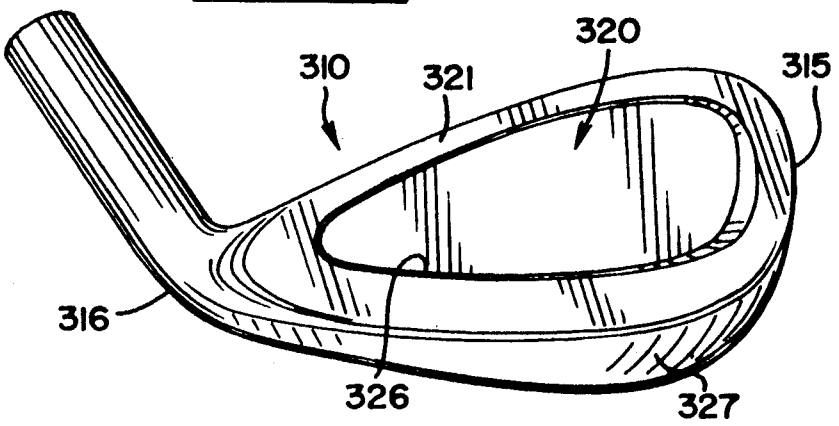
FIG. 7 is a back elevational view of a four iron head, with a view taken normal to the face of the club head.

Referring now to FIG. 7, the construction of the club head 310 for the four iron is illustrated. In the illustration of FIG. 7, the components of the head 310 are identified by the same reference numerals, plus three hundred digits, as the corresponding components of the one iron head 10.

The club head 310 differs from the head 210 of the three iron in that the cavity 320 in the back 321 of the blade 311 is still narrower and shorter. As such, its center is moved further upwardly and outwardly toward the toe 315 of the blade at a 45° angle. Here, the lower edge 326 of the cavity 320 is 13/32 of an inch from the sole 327 of the blade. The cavity 320 is now 2 and 20/32 inches long. The center of gravity and weight of the club head 310 has again moved slightly upwardly and toward the heel 316.

Figure 8:
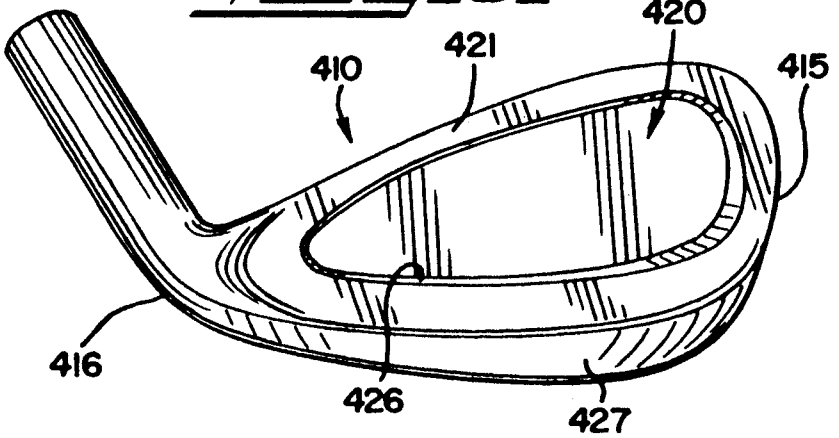
FIG. 8 is a back elevational view of a five iron head, with a view taken normal to the face of the club head.

Referring now to FIG. 8, the construction of the club head 410 for the five iron is illustrated. In the illustration of FIG. 8, the components of the head 410 are identified by the same reference numerals, plus four hundred digits, as the corresponding components of the one iron head 10.

The club head 410 differs from the head 310 of the four iron in that the cavity 420 in the back 421 of the blade 411 is still narrower and shorter. As such, its center is moved further upwardly and outwardly toward the toe 415 of the blade at a 45° angle. Here, the lower edge 426 of the cavity 420 is 15/32 of an inch from the sole 427 of the blade 411. The cavity 420 is now 2 and 17/32 inches long. The center of gravity and weight of the club head 410 has again moved slightly upwardly and toward the heel 416.

Figures 9, 10, 11, 12, 13:
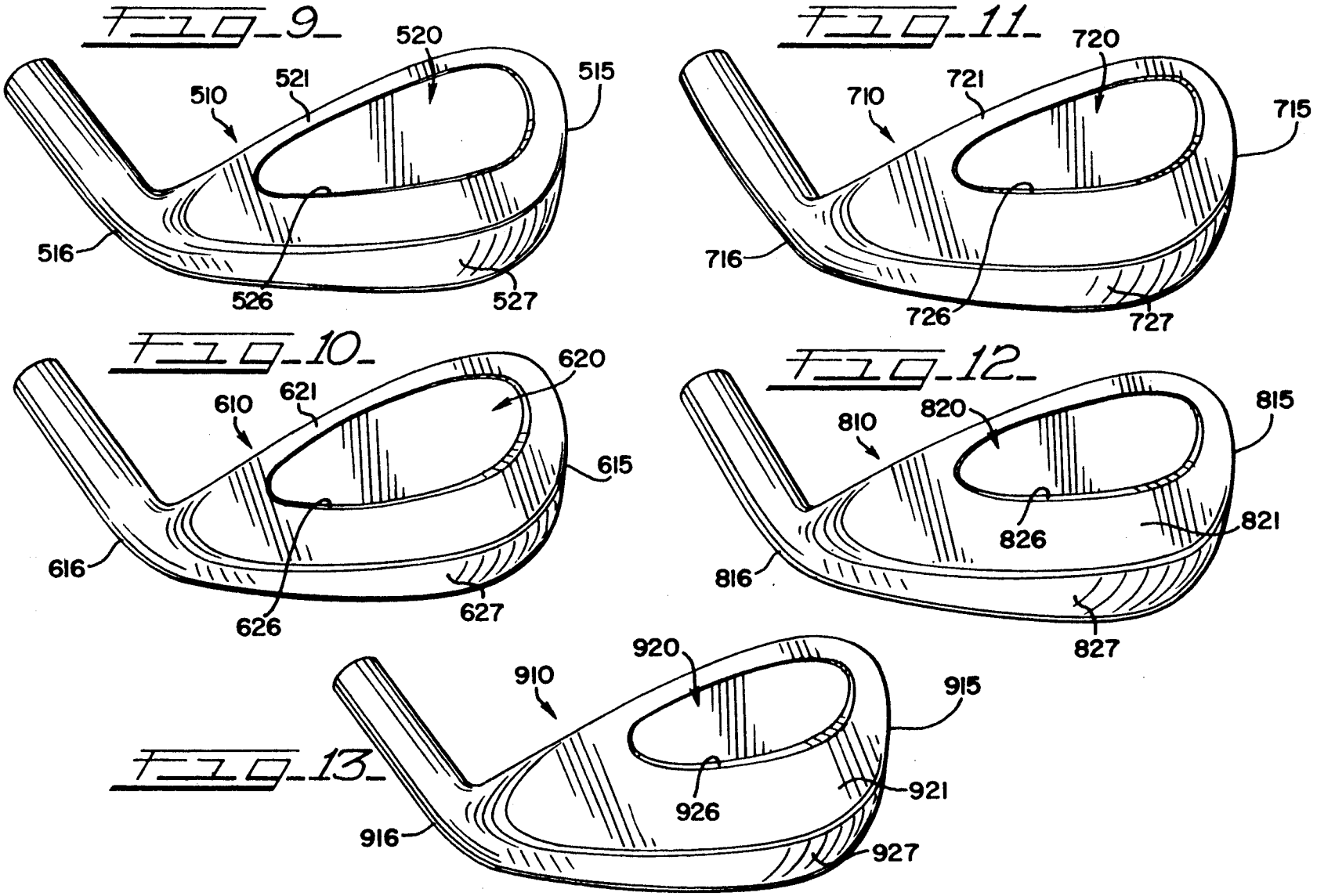
FIG. 9 is a back elevational view of a six iron head, with a view taken normal to the face of the club head.
FIG. 10 is a back elevational view of a seven iron head, with a view taken normal to the face of the club head.
FIG. 11 is a back elevational view of a eight iron head, with a view taken normal to the face of the club head.
FIG. 12 is a back elevational view of a nine iron head, with a view taken normal to the face of the club head.
FIG. 13 is a back elevational view of a ten iron head, with a view taken normal to the face of the club head.

Referring now to FIG. 9, the construction of the club head 510 for the six iron is illustrated. In the illustration of FIG. 9, the components of the head 510 are identified by the same reference numerals, plus five hundred digits, as the corresponding components of the one iron head 10.

The club head 510 differs from the head 410 of the five iron in that the cavity 520 in the back 521 of the blade 511 is still narrower and shorter. As such, its center is moved further upwardly and outwardly toward the toe 515 of the blade at a 45° angle. Here, the lower edge 526 of the cavity 520 is 17/32 of an inch from the sole 527 of the blade 511. The cavity 520 is now 2 and 13/32 inches long. The center of gravity and weight of the club head 510 has again moved slightly upwardly and toward the heel 516.

Referring now to FIG. 10, the construction of the club head 610 for the seven iron is illustrated. In the illustration of FIG. 10, the components of the head 610 are identified by the same reference numerals, plus six hundred digits, as the corresponding components of the on iron head 10.

The club head 610 differs from the head 510 of the six iron in that the cavity 620 in the back 621 of the blade 611 is still narrower and shorter. As such, its center is moved further upwardly and outwardly toward the toe 615 of the blade at a 45° angle. Here, the lower edge 626 of the cavity 620 is 19/32 of an inch from the sole 627 of the blade 611. The cavity 620 is now 2 and 10/32 inches long. The center of gravity and weight of the club head 620 has again moved slightly upwardly and toward the heel 616.

Referring now to FIG. 11, the construction of the club head 710 for the eight iron is illustrated. In the illustration of FIG. 11, the components of the head 710 are identified by the same reference numerals, plus seven hundred digits, as the corresponding components of the one iron head 10.

The club head 710 differs from the head 610 of the seven iron in that the cavity 720 in the back 721 of the blade 711 is still narrower and shorter. As such, its center is moved further upwardly and outwardly toward the toe 715 of the blade at a 45° angle. Here, the lower edge 726 of the cavity 720 is 27/32 of an inch from the sole 727 of the blade 711. The cavity 720 is now 2 and 4/32 inches long. The center of gravity and weight of the club head 710 has again moved slightly upwardly and toward the heel 716.

Referring now to FIG. 12, the construction of the club head 810 for the nine iron is illustrated. In the illustration of FIG. 12 the components of the head 810 are identified by the same reference numerals, plus eight hundred digits, as the corresponding components of the one iron head 10.

The club head 810 differs from the head 710 of the eight iron in that the cavity 820 in the back 821 of the blade 811 is still narrower and shorter. As such, its center is moved further upwardly and outwardly toward the toe 815 of the blade at a 45° angle. Here, the lower edge 826 of the cavity 820 is 23/32 of an inch from the sole 827 of the blade 811. The cavity 820 is now 2 and 2/32 inches long. The center of gravity and weight of the club head 810 has again moved slightly upwardly and toward the heel 816.

Finally, referring to FIG. 13, the construction of the club head 910 for the ten iron is illustrated. In the illustration of FIG. 13, the components of the head 910 are identified by the same reference numerals, plus nine hundred digits, as the corresponding components of the one iron head 10.

The club head 910 differs from the head 810 of the nine iron in that the cavity 920 in the back 921 of the blade 911 is still narrower and shorter. As such, its center is moved further upwardly and outwardly toward the toe 915 of the blade at a 45° angle. Here, the lower edge 926 of the cavity 920 is 24/32 of an inch from the sole 927 of the blade 911. The cavity 920 is now 1 and 30/32 inches long. The center of gravity and weight of the club head 910 has once again moved slightly upwardly and toward the heel 916.

To summarize the relative size and positioning of the club head cavities in the disclosed embodiment, following is a chart comparing them as club length decrease:

| IRON | CAVITY LENGTH | DISTANCE OF CAVITY FROM SOLE |
|---|---|---|
| 1 | 2 27/32 inches | 6/32 inches |
| 2 | 2 26/32 inches | 9/32 inches |
| 3 | 2 23/32 inches | 11/32 inches |
| 4 | 2 20/32 inches | 13/32 inches |
| 5 | 2 17/32 inches | 15/32 inches |
| 6 | 2 13/32 inches | 17/32 inches |
| 7 | 2 10/32 inches | 19/32 inches |
| 8 | 2 4/32 inches | 22/32 inches |
| 9 | 2 2/32 inches | 23/32 inches |
| 10 | 1 30/32 inches | 24/32 inches |

The distance from the cavity to the toe is uniformly about ¼ of an inch. The distance from the cavity to the upper edge of the blade is about 9/32".

While a preferred embodiment of the invention has been described, it should be understood that the invention is not limited thereto. Modifications may be made without departing from the invention. The scope of the invention is defined by the appended claims, and all devices that come within the meaning of the claims, either literally or by equivalents, are intended to be embraced therein.

I claim:

1. In a series of golf club irons between one and ten having progressively shorter lengths and greater lofts, wherein the head of each iron includes a blade having a face, a back, a sole, a top, a toe and a heel, the improvement comprising:

a) cavities formed in the back of a plurality of said blades, including the one iron;

b) each of said cavities having a cavity base and a top edge, a bottom edge, a front edge and a back edge defining a cavity outline, the length of the cavity being measured from front edge to back edge, the width from top edge to bottom edge and the depth from the back of the blade to the cavity base;

c) the length of said cavities becoming progressively shorter as the loft of the club increases so that the centers of gravity of the blades move progressively toward the heel of the blade as the loft of the club increases;

d) the width of said cavities becoming progressively narrower as the loft of the club increases so that centers of gravity of the blades move progressively upwardly away from the sole as the loft of the club increases;

e) the centers of gravity of the blade moving progressively upwardly toward the top and inwardly toward the heel of the blade at approximately a 45° angle from club to club, as the loft of the club increases; and f) (e)) the outline of the cavity in the one iron is only slightly smaller than the back of the blade.

2. In a series of golf club irons between one and ten having progressively shorter lengths and greater lofts, wherein the head of each iron includes a blade having a face, a back, a sole, a top, a toe and a heel, the improvement comprising:

a) cavities formed in the back of a plurality of said blades, including the one iron;

b) each of said cavities having a cavity base and a top edge, a bottom edge, a front edge and a back edge defining a cavity outline, the length of the cavity being measured from front edge to back edge, the width from top edge to bottom edge and the depth from the back of the blade to the cavity base;

c) the length of said cavities becoming progressively shorter as the loft of the club increases so that the centers of gravity of the blade move progressively toward the heel of the blade as the loft of the club increases;

d) the width of said cavities becoming progressively narrower as the loft of the club increases and the bottom edge of each of said cavities moving progressively away from the sole of the club as the loft of the club increases so that centers of gravity of the blades move progressively upwardly away from the sole as the loft of the club increases;

e) the back edge of each of said cavities moving progressively away from the heel of the club as the loft of the club increases; and f) the outline of the cavity in the one iron is only slightly smaller than the back of the blade.

3. The improvement in the series of golf club irons of claim 2, further characterized in that:

a) the top edge of each of said cavities remains approximately the same distance from the top of the corresponding blade as the loft of the club increases; and b) the front edge of each of said cavities remains approximately the same distance from the toe of the corresponding blade as the loft of the club increases.

* * * * *